US006480154B1

(12) United States Patent
Bella et al.

(10) Patent No.: US 6,480,154 B1
(45) Date of Patent: Nov. 12, 2002

(54) METHOD AND SYSTEM FOR DIGITAL BEAM FORMING

(75) Inventors: Luigi Bella, Noordwijk-aan-Zee; Stefano Badessi, Noordwijkerhout, both of (NL); Bernhard Grafmueller, Markdorf (DE)

(73) Assignee: Agence Spatiale Europeenne, Paris (FR)

( * ) Notice: Subject to any disclaimer, the term of this patent is extended or adjusted under 35 U.S.C. 154(b) by 0 days.

(21) Appl. No.: 09/543,286

(22) Filed: Apr. 5, 2000

(30) Foreign Application Priority Data

Apr. 7, 1999 (FR) ..... 99 04325

(51) Int. Cl.[7] ..... H01Q 3/22; H01Q 3/24; H01Q 3/26

(52) U.S. Cl. ..... 342/372; 342/373; 342/157

(58) Field of Search ..... 342/372, 373, 342/157

(56) References Cited

U.S. PATENT DOCUMENTS 5,396,256 A * 3/1995 Chiba et al. ..... 342/372

OTHER PUBLICATIONS

Godara, Lal C., "Application of Antenna Arrays to Mobile Communications, Part II: Beam–Forming and Direction–of–Arrival Considerations," *Proceedings of the IEEE*, vol. 85, No. 8, Aug. 1997, pp. 1195–1245.

Miura, Ryu, "Beamforming Experiment with a DBF Multi-beam Antenna in a Mobile Satellite Enviorment," *IEEE Transactions on Antennas and Propagation*, vol. 45, No. 4, Apr. 1997, pp. 707–714.

* cited by examiner

*Primary Examiner*—Theodore M. Blum
(74) *Attorney, Agent, or Firm*—Barry R. Lipsitz; Douglas M. McAllister

(57) ABSTRACT

In accordance with the invention, the digital samples associated with each of the array elements arranged along a plurality of parallel lines are shifted by a distinct predetermined number of positions along each of said lines, and the digital samples of each line are added separately. Thereafter, each sum thus obtained is multiplied by a distinct phase coefficient. The signals thus obtained for each beam are all in phase. The lines of array elements that are electronically scanned can be oriented along any direction, and advantageously along one or a plurality of diagonals of the array and the electronic scanning of the array elements can be made separately along odd alternate diagonals and along even alternate diagonals.

9 Claims, 10 Drawing Sheets

METHOD AND SYSTEM FOR DIGITAL BEAM FORMING

DESCRIPTION

1. Field of the Invention

The present invention relates to phased array antennas used in satellite communication systems. In particular, the invention relates to a method and a system for the digital beam forming at the transmit and/or receive side of a phased array antenna.

2. Background of the Invention

A phased array antenna is an antenna configuration useful to transmit and receive signals in a plurality of independent beams. The antenna aperture is subdivided into a plurality of sub-arrays in which each sub-array or patch consists in one or several radiating elements. The phase difference between the electromagnetic waves in the different beams determine the transmit or arrival direction of the beams. By applying appropriate phase shifts to the signals at each element, beams can be created and steered in any direction. In principle, separate phase shifts need to be performed at each patch for each beam.

Phase shifting can be performed by analog devices after low noise amplification on the receive side of a link and before high power amplification on the transmit side. It can also be performed by digital means using complex digital operations if the signal is converted into digital form.

Analog implementations are typically frequency-dependent and limited by the complexity of the interconnections and the precision of tuning (physical volume, losses, stability over age and temperature, manufacturing yield can become critical). Therefore, wideband implementations over a large field of view are difficult and a practical limit does also exist for the product number of beams times the number of patches. Digital implementations are limited by the power consumption, which is proportional to the signal bandwidth times the number of beams times the number of patches.

The concept of phased array antennas steered by beam forming has found several practical applications, namely in constellations of mobile satellite services operated in L or S band. These applications have been made possible by somehow favouable boundary conditions: beams are few or not steered in real time or anyhow carrying a very limited bandwidth which is well suited for digital implementation without major adaptations. Losses at L or S band are reasonably low for analog equipment. Each system operates in a reserved frequency band, so interference may not need tight control to conform to third party requirements. Furthermore, intra-system interference is mitigated by using signals which are orthogonal either in code or in time/frequency, thus somehow relaxing the need of side lobe control. The same concepts are not usable with future wideband systems, e.g. the upcoming K-band, on account of the difficulties that arise in that case.

The number of radiating elements per phased array increases by one order of magnitude to achieve the desired gain without creating unacceptable side lobes. The number of beams is also at the high end of current experience. Losses, mismatches, connections issues, tuning accuracy become more critical at such high frequency. Increased accuracy in beam steering is more and more required with the advent of non-geostationary systems.

All these aspects make analog beam forming extremely difficult, and especially as the new system generation will need tight shaping of side lobes and in general interference control. This growing need is due to the following factors:

1) inter-system coordination issues in an ever more packed frequency spectrum with several geostationary sharing the same frequency band,
2) intra-system tight interference control, originated by the push towards intensive frequency re-use to accomodate more traffic in the limited spectrum remaining available in K-band for generalised VSAT services (only 500 MHz out of 3 GHz).

Digital beam forming (DBFN) is therefore regarded as the natural solution to most of the problems referred to above. However, the complexity of the beam forming system is proportional to the number of sub-arrays or patches and to the number of beams and to the frequency bandwidth. The higher the complexity of the processing to be applied to the signal representative of the transmitted electromagnetic waves, the higher the power consumption required for the processing. The large number of patches and beams as well as the wideband characteristics of the future communication systems suggest that the power consumption achievable with conventional digital beam forming techniques will be prohibitive for satellite accomodation.

The digital beam forming (DBFN) schemes have been based so far on the principle of transforming the well known analog phase shift function into a directly equivalent digital operation, i.e. a complex multiplication. Various optimisations have been attempted on the digital algorithm to be used and on the numeric approximations, but always within the framework of the same basic principle of direct correspondence between the analog and digital schemes.

SUMMARY OF THE INVENTION

It is an object of the present invention to provide a novel and efficient digital beam forming method usable in steering a phased array antenna operating with a large number of wideband beams.

Another object of this invention is to provide a wideband digital beam forming system which needs a limited power consumption thereby to make it suitable for satellite implementation.

In accordance with the invention, the digital samples associated with each of the array elements arranged along a plurality of parallel lines are shifted by a distinct predetermined number of positions along each of said lines, and the digital samples of each line are added separately. Thereafter, each sum thus obtained is multiplied by a distinct phase coefficient. The signals thus obtained for each beam are all in phase. The lines of array elements that are electronically scanned can be oriented along any direction, and advantageously along one or a plurality of diagonals of the array and the electronic scanning of the array elements can be made separately along odd alternate diagonals and along even alternate diagonals.

The invention allows digital beam forming to be achieved using a number of multiplications that is considerably reduced as compared to the prior art systems. As a result, the signal processor needs a lower power consumption for the phase shift control. Such a reduced power consumption allows the method of the invention to be used in a great number of applications, and especially in applications where a limitation of the power consumption is of a primary importance, for instance in implementations on board a satellite.

The digital beam forming of this invention is particularly advantageous in applications which operate with a large number of beams. For an array antenna having a square lattice of 32×32 radiating elements generating 64 beams, each one with a 128 MHz bandwidth, the digital beam forming using the system of the invention only needs a power consumption in the order of 1 kW as against a power consumption in excess of 3 kW with a conventional digital beam forming scheme.

The digital beam forming system can be implemented using various arrangements of digital devices known per se.

The features and advantages of the invention will become more apparent by referring to the following detailed description in conjunction with the accompanying drawings.

DETAILED DESCRIPTION OF THE INVENTION

Figure 1:
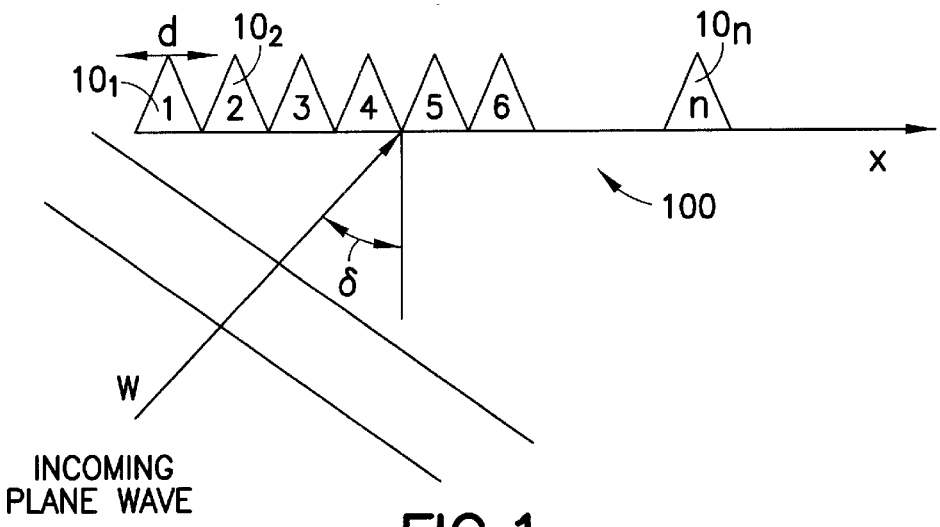
FIG. 1 shows a diagram illustrating the phase shift of an electromagnetic wave arriving at each one of the radiating elements of an array antenna.

FIG. 1 represents a row of radiating elements of an array antenna 100 including a plurality of array elements $\mathbf{10}_1$, $\mathbf{10}_2$, . . . $\mathbf{10}_n$ arranged in a lattice configuration for receiving or transmitting signals in certain directions. For simplicity, the following description will be directed to the receive side of the array, The same considerations hold for the transmit side. Depending on the signal direction, the incoming electromagnetic wave W arrives at each array element $\mathbf{10}_i$ with different phases. The phase difference between array elements depends on the element spacing d and the angle of direction-of-arrival δ of the electromagnetic wave W. The function of a beam forming system is to compensate for the phase difference of each signal transmitted or received by each array element. The present invention is concerned with the control of the phase shift to be applied using a digital processing scheme.

Figure 2:
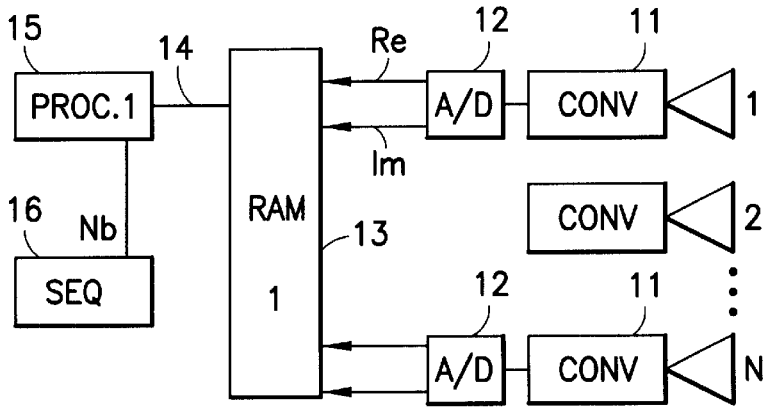
FIG. 2 is a block diagram of a digital beam forming system according to the present invention.

FIG. 2 shows a block diagram of a beam forming system implementing the phase shift control method of the invention at the receive side of an array antenna. The system is intended to receive a beam composed of N electromagnetic waves, each one being transmitted by an array element of a transmit antenna and each one being intended to be received at an array element of a receive antenna. Each wave is received in an amplifier/frequency converter stage 11, and then in an analog-to-digital (A/D) converter stage 12 which generates digital samples representing the real part Re and the imaginary part Im of the complex number that represents the electromagnetic wave.

The digital samples Re and Im delivered by each A/D converter are all stored in a RAM store 13 having a capacity of 2N bytes. The samples are read from the RAM store and passed through a pipeline 14 to a beam forming processor 15 adapted to process them using an appropriate processing software for the purpose of applying the required phase shift coefficient to these samples as will be described later herein. Once the correct phase shifts have been controlled in accordance with the method of the invention, the signals representative of all the beams are passed to a beam sequencer 16 adapted to restore the correct time sequence.

The digital processing of the signal samples is performed in the beam forming processor 15 according to the method of the invention disclosed herein after. The beam forming processor 15 includes, for instance, shift registers connected to accept the digital samples and controlled to shift each sample by a predetermined number of positions to the right.

Consider a square lattice having elements arranged in (M+1) rows and (N+1) columns. Straightforward extrapolations are valid for rectangular lattices M×N or other configurations. The processing principle according to the invention is set out for the receive side of a link, but it is applicable to the transmit side as well.

The phase shift to be performed at element (m,n) for a beam scanned in direction (u, v) is given by:

$$\beta(m,n)=k(ndu+mdv)$$

with d denoting the row and column spacing and $k=1/\lambda$ denoting the wave number.

The phase at element (m,n) consists of two components:

$$\beta(m,n)=\beta(m)+\beta(n)$$

The phase distribution over the array is represented by the matrix (Table A):

| | | | | |
|---|---|---|---|---|
| M | MIφo | (MI + I)φo | . . . | (MI + M)φo |
| . . . | . . . | . . . | . . . | . . . |
| 2 | 2Iφo | (2I + 1)φo | . . . | (2I + M)φo |
| 1 | Iφo | (I + 1)φo | . . . | (I + M)φo |
| 0 | 0 | φo | . . . | M φo |
| | 0 | 1 | . . . | M |

where φo=kdu and Iφo=kdv with φo denoting an elementary phase step.

The key feature of the processing according to the invention consists in shifting the signals from row m by (ml) positions to the right. The phase distribution then is such that the elements in every column contain signals having the same phase in the same position. The signals in corresponding elements in each row are then added and each sum thus obtained is then multiplied by the appropriate phase (0, φo, 2φo, . . . Mφo).

The complete processing only requires one multiplication per column, which represents a number of multiplications that is drastically reduced as compared to the number of multiplications which are required with the prior art digital beam forming schemes.

The invention thus allows a perfect control of the complexity of the system which requires only:

M+1 shift registers with length L,

L multipliers and L (M+1) adders.

The system complexity is considerably reduced. However, in case of large phase shifts, the signals from the elements are shifted by several positions and this leads to a large rectangular matrix comprising several columns and therefore still requiring a lot of multiplications.

In order to overcome this disadvantage, the scan angle $\phi o$ is chosen such that: $2\pi = L\,\phi o$, with integer L. In this way, the array elements which are shifted out of the square pattern, re-enter same from the left side since phases are invariant to multiples of $2\pi$. In other words, circular shift registers can simply be implemented instead of linear registers.

The result is that the matrix remains square with well controlled dimensions and only (M+1) shift registers with L positions are needed. The number of multipliers is also reduced to L for any phase shift value, and the number of adders is L(M+1).

This phase shift control achieves a satisfactory coverage in the regions close to the coordinate axes. However, coverage is poor in the areas just above and below the 45° and 135° diagonals. Summarized, the middle regions between the axes are critical areas as regards coverage.

Figure 3:
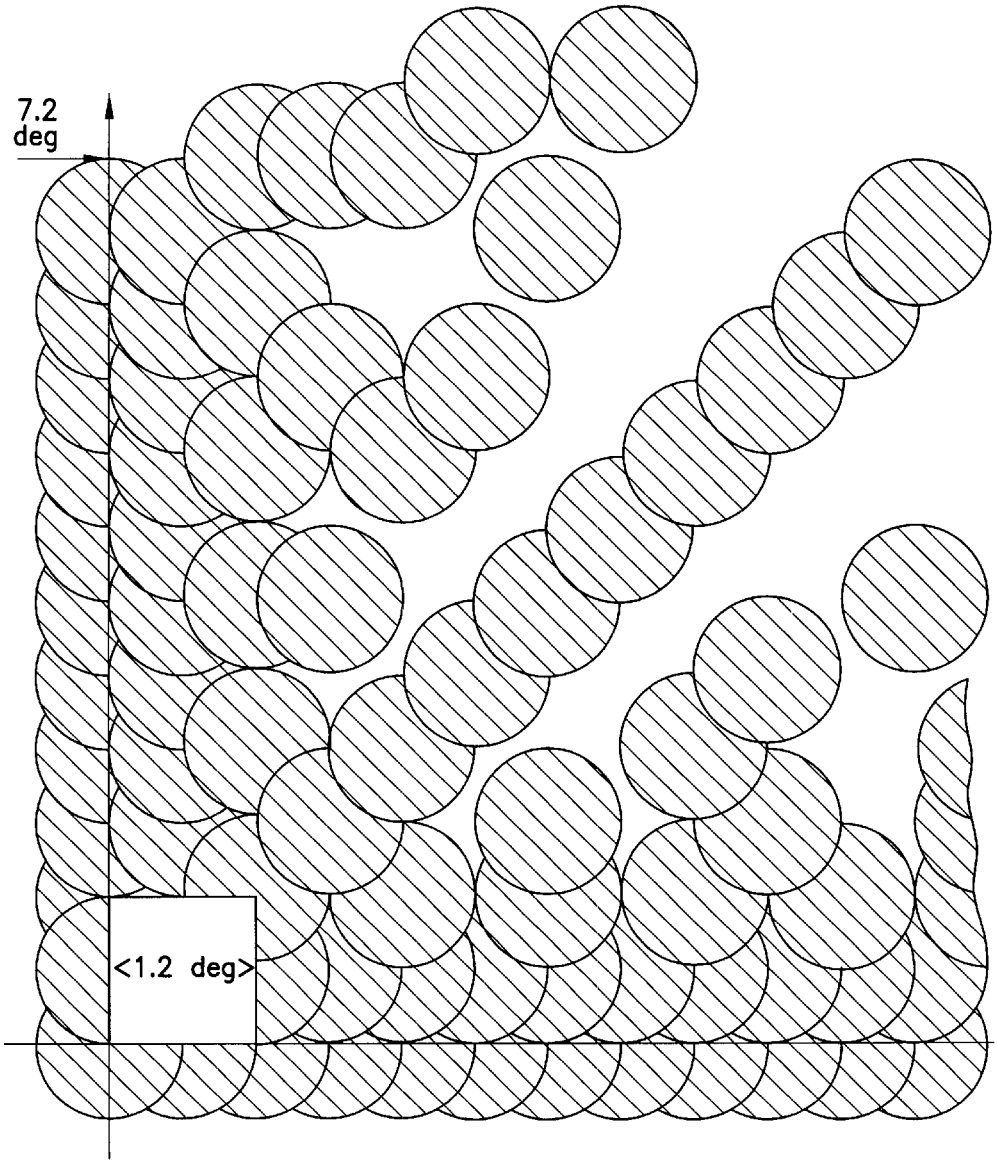
FIG. 3 illustrates the coverage obtained with an antenna scanned along directions parallel to the horizontal and vertical coordinate axes.

FIG. 3 shows a diagram illustrating the theoretical positions of the beams on an array of 32×32 elements with the following parameter values:

| | |
|---|---|
| $d = \sqrt{2}\lambda$ | $u_0 = v_o = 1/\sqrt{2}$ |
| L = 64 | Min(u) = Min(v) = ±0.6 deg. |
| Bandwidth:3dB | 2Min(u) = ±1.2 deg. |

A development of the inventive concept aims at optimizing the coverage along directions in the array plane which are different from the horizontal and vertical ones, thereby to afford a practically usable overall coverage for a great number of applications.

Consider for instance the first quadrant of an (M+1)×(M+1) lattice. The prime object is to optimize the coverage around the directions at ±45° with respect to the horizontal and vertical axes.

The array can be looked at as the combination of elements arranged in two sets of diagonals:

(a) a set S1 of diagonals including the main diagonal (45°) and the odd alternate ones; the r-th such diagonal consists of the elements that are at multiples of the scan step $\phi$1', increased by r1 when passing from one diagonal to the next one;

(b) a set S2 of diagonals including the even alternate diagonals parallel to the main diagonal; the r-th such diagonal consists of the elements the signals of which are the sum of a constant part $\phi o'$ and a variable part multiple of $\phi$1'. The variable part of each element is increased by r1 when passing from one diagonal to the next one in the same set S2.

The processing disclosed earlier herein is performed separately with the signals from the elements located along the diagonals of each of the two sets S1 and S2. The signals from the elements on each diagonal m are shifted by ml along the diagonal in a shift register, and added along the cross-diagonal direction. The sums thus obtained are multiplied by the appropriate phases. Of course, the main diagonal direction and the cross-diagonal direction can be interchanged as do the horizontal and vertical directions in the processing scheme set out earlier herein.

The shift step $\phi$1' and the length of the shift register are advantageously chosen such that: $L'\phi\mathbf{1}' = 4\pi$ to make sure that the auxiliary shift step also leads to a periodic phase behaviour.

For the set S1 of diagonals, the processing needs M+1) shift registers with length L'/2 and L'/2 multipliers since the elements that are multiples of $\phi$1' repeat periodically after a shift by L' positions along the diagonal. Processing the set S2 of diagonals needs (M+1) shift registers with length L' and the signals from said set S2 can be processed in conjunction with the signals from set S1.

Table (A) above can be transformed to show a similar phase distribution along the diagonal directions instead of the row and column directions.

Using a notation prime for the elements to be optimized along the diagonals, the following relations and Table (B) hold:

| | | | | |
|---|---|---|---|---|
| $(3I + 2)\phi 1'$ | $\phi o' + (2I + 2)\phi 1'$ | $(2I + 3)\phi 1'$ | $\phi o' + (I+3)\phi 1'$ | $(I + 4)\phi 1'$ |
| $\phi o' + (2I + 1)\phi 1'$ | $(2I + 2)\phi 1'$ | $\phi o' + (I+2)\phi 1'$ | $(I + 3)\phi 1'$ | $\phi o' + 3\phi 1'$ |
| $(2I + 1)\phi 1'$ | $\phi o' + (I + 1)\phi 1'$ | $(I + 2)\phi 1'$ | $\phi o' + 2\phi 1'$ | $3\phi 1'$ |
| $\phi o'$ | $(I + 1)\phi 1'$ | $\phi o' + \phi 1'$ | $2\phi 1'$ | |
| $I\phi 1'$ | $\phi o'$ | $\phi 1'$ | $\phi o' - \phi 1'$ | |
| $\phi o' - \phi 1'$ | 0 | $-\phi o'$ | $-(I + 1)\phi 1'$ | |

with $\phi$1' denoting the shift step along the main diagonal, $\phi\mathbf{1}' = [(\mathbf{1}+1)\phi\mathbf{1}']/2$ denoting the auxiliary shift step, ($\phi$1'{integer I} denoting the shift step along the cross diagonal.

If I is odd, $\phi o'$ reduces to a multiple of $\phi$1' and S2 contains multiples of $\phi$1', shifted along the diagonal as for set S1. Therefore, corresponding elements in S1 and S2 can be added prior to multiplications are performed and the total number of multipliers that are needed to process S1 and S2 remains L'/2, although the number of additions is increased to 2(M+1)L'/2.

If I is even, a partial addition of the S2 elements along the cross-diagonals is performed. There is thus obtained L' partial sums, that are multiples of $\phi$1'/2. At the same time (i.e. prior to phase shifting), L'/2 partial sums of S1 elements, multiples of 2($\phi$1'/2) are performed and each of them is added to the corresponding sum obtained for set S2. Altogether, processing the elements of both sets S1 and S2 needs 3(M+1)L'/2 additions and L' multiplications.

In short, for processing the S1 and S2 elements, the system according to the invention requires to a maximum:

M+1 shift registers with length L',

L' multipliers,

3(M+1)L'/2 adders.

Figure 4:
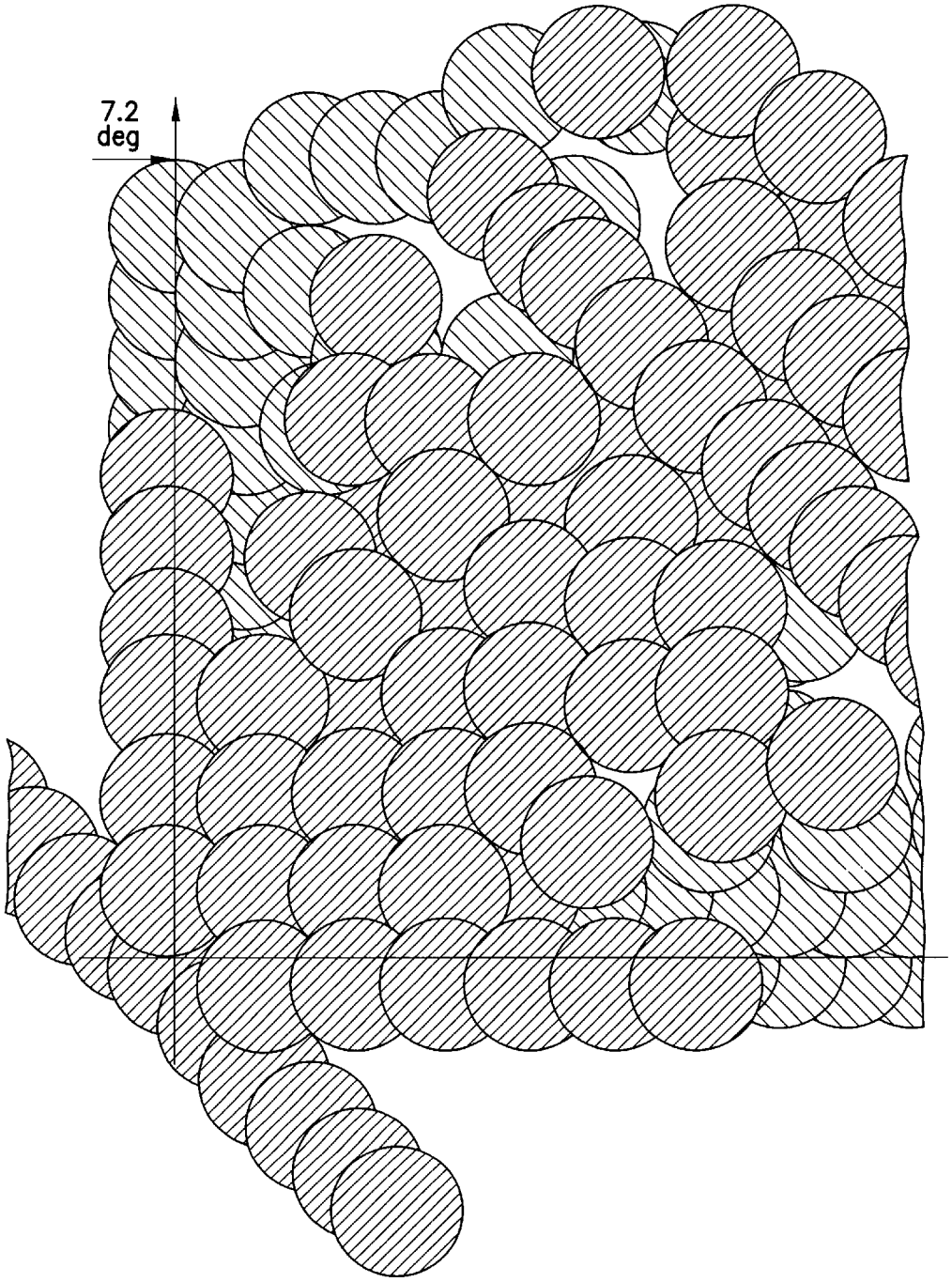
FIG. 4 illustrates the coverage obtained with an antenna scanned along directions at 45° with respect to the horizontal and vertical coordinate axes.

The coverage achieved with the signal processing as set out above is illustrated by the diagram of FIG. 4. It can be observed that the coverage is substantially increased as compared to the diagram illustrated in FIG. 3. Perfect coverage is achieved in the area within an arc up to about 6°. A very few holes only appear on either side of this area.

It is to be noted that these very few holes can be easily covered by conventional beam forming techniques. Because these residual areas only call for a reduced number of beams, the additional cost in terms of power consumption has no significant effect on the overall power consumption.

An improvement to the invention permits the discrete set of usable beam directions to be increased for efficient digital beam forming when taking also the grating lobes into account. These lobes are normally unwanted by-products of an array antenna, due to the fact that a certain phase distribution is linked not only to the wanted beam direction, but also to the other ones. Grating lobes are inherent in phased arrays: they are normally falling outside the coverage area of the antenna or they are cut by the antenna radiation pattern by an appropriate choice of the parameters of the antenna radiation pattern.

The concept of the invention advantageously allows grating lobes having particular beam directions to be exploited and used as wanted beams in the beam forming processing in order to further increase the processing efficiency. This particularly advantageous improvement permits to considerably increase the number of usable directions for the beam arriving at or transmitted by an array antenna.

Figure 5:
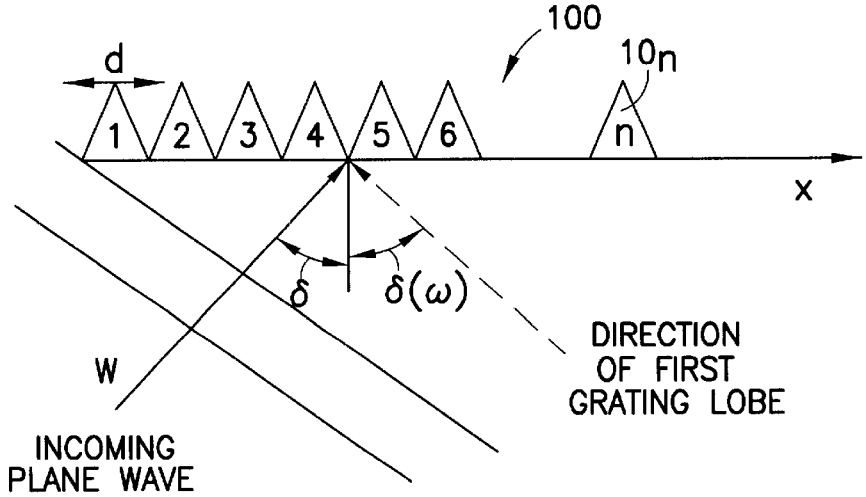
FIG. 5 shows a diagram similar to that of FIG. 1, but illustrating the direction of the first side lobe of the beam arriving at the radiating elements of an array antenna.

When considering an array antenna 100 as represented in FIG. 5, the invention permits not only the direction u=sin δ of the electromagnetic wave W to be reached as set out herein before, but also the direction u(w)=sin(w) of the first grating lobe.

These beam directions are represented by the following relations:

$$u=\sin\delta=j/L\lambda/d$$

$$u(w)=\sin\delta(w)=\sin\delta+w\lambda/d=j/I\lambda/d+w\lambda/d.$$

In accordance with the invention, the factor j is chosen to be greater than L. The grating lobe of order w is steered so as to fall in the coverage area, whereby it can be used as useful beam, while the other lobes are maintained outside the coverage area.

Accordingly, instead of having the scan directions limited to the set of directions as defined earlier herein, the following additional set of beam directions can be reached:

$$u=\mathrm{mod}[j,\ L](u_o L)$$

$$v=]u=[j(v_o/L)$$

$$\mathrm{mod}[j,L]=j-\mathrm{int}[j-\tfrac{1}{2}L]L.$$

It can be shown that the largest number of directions can be reached when the factors common to j and L are minimized. Ideally, factor L is a prime number.

Furthermore, the number L needs to be larger than the number of elements (M+1) to avoid that more than one beam of order w fall in the coverage area. Furthermore, number L shall preferably be a multiple of the number of elements thereby to allow periodic circular shifts to be implemented.

Figure 6:
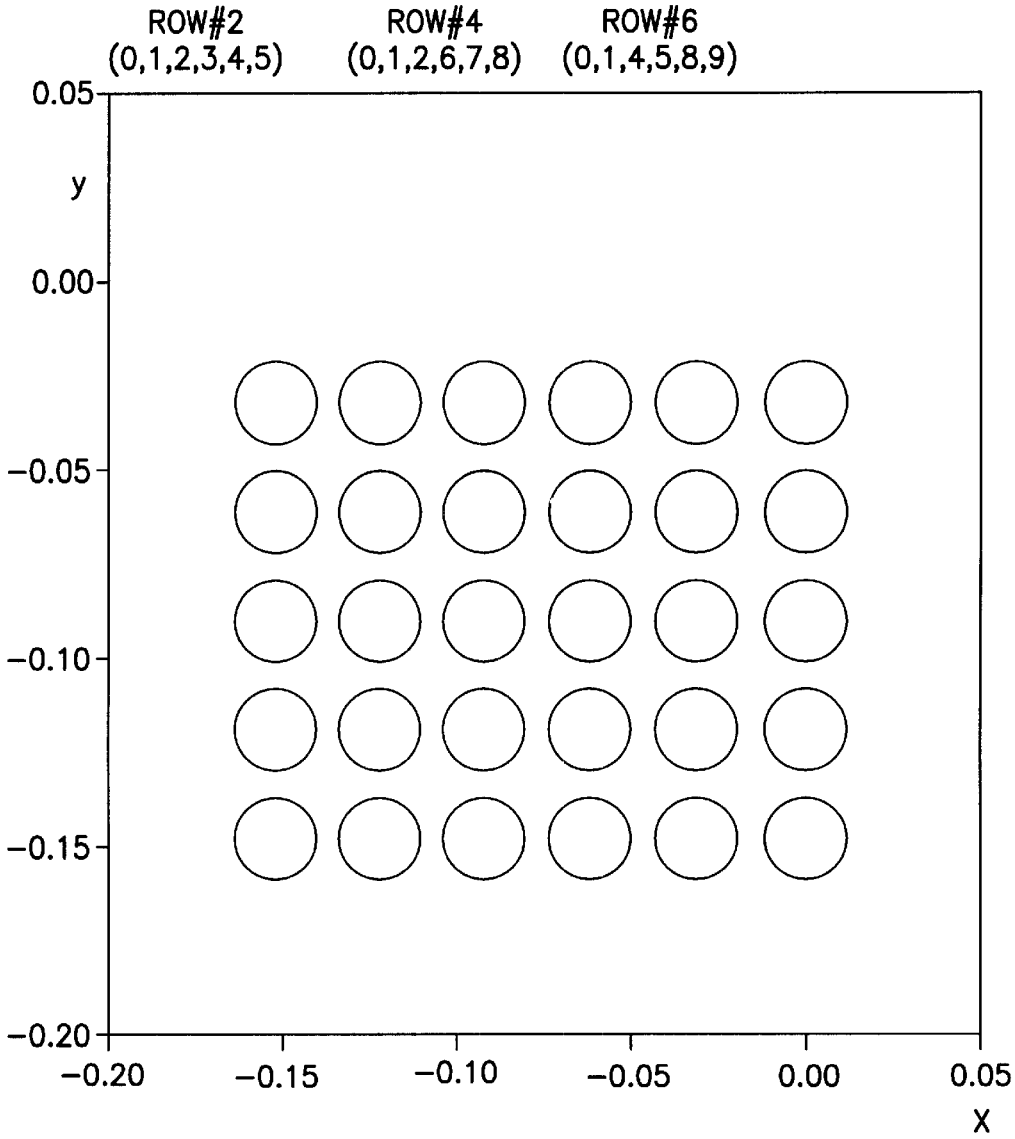
FIG. 6 to FIG. 9 illustrate an example of array scanning sequence in accordance with the method of the invention to optimise the beam coverage.
Figure 7:
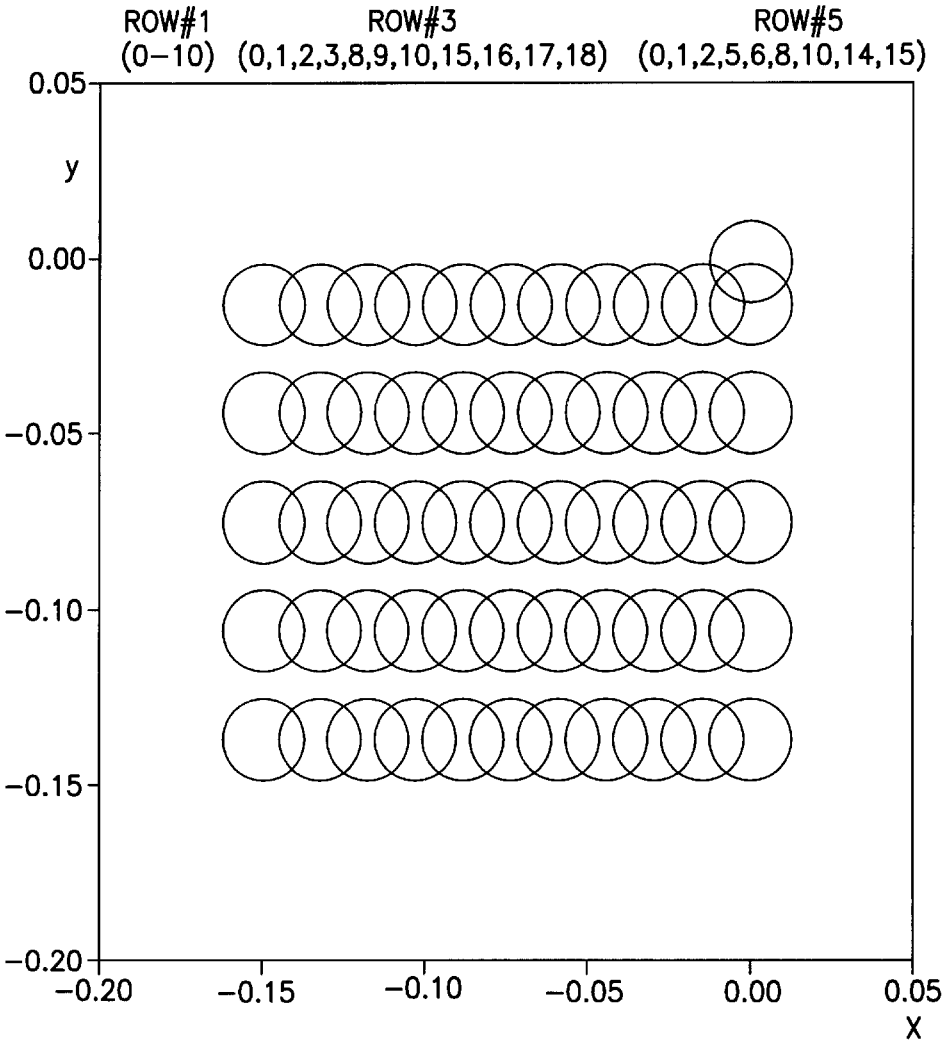
Figure 8:
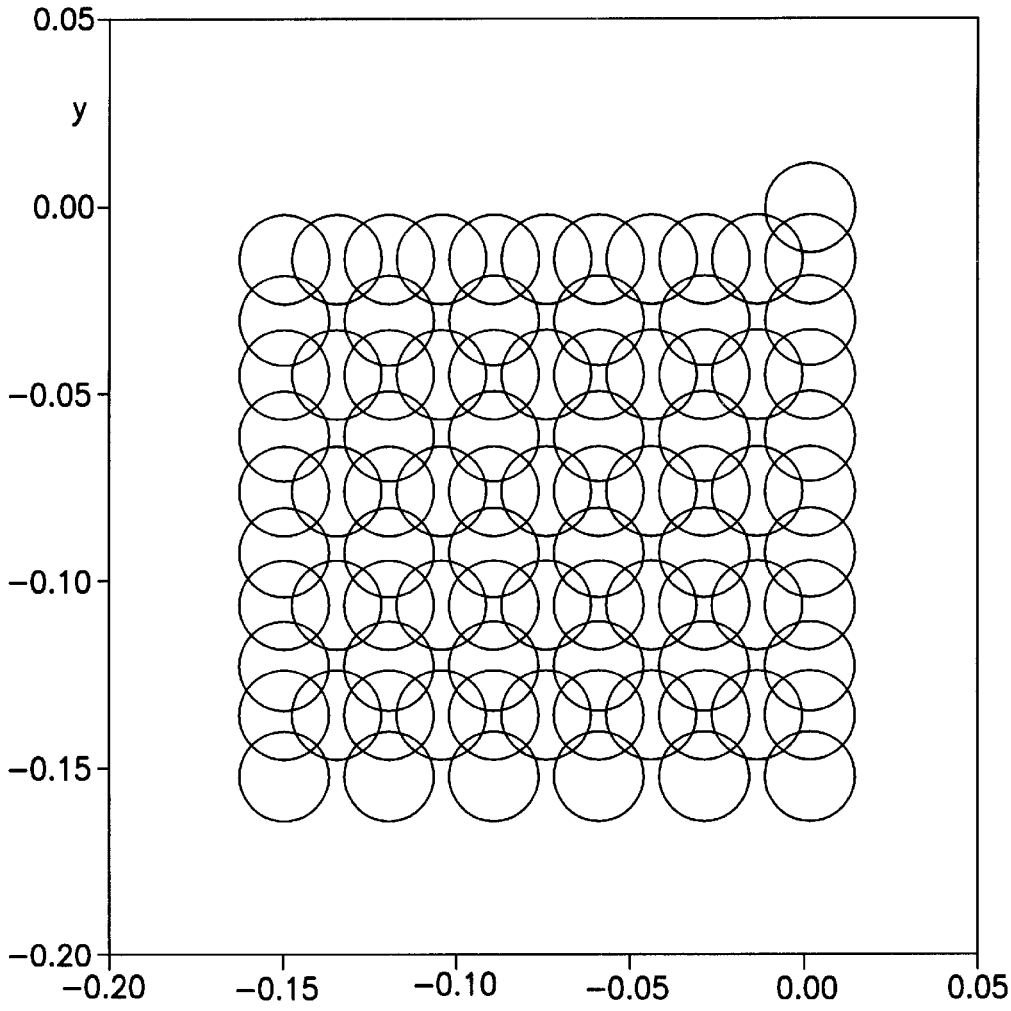
Figure 9:
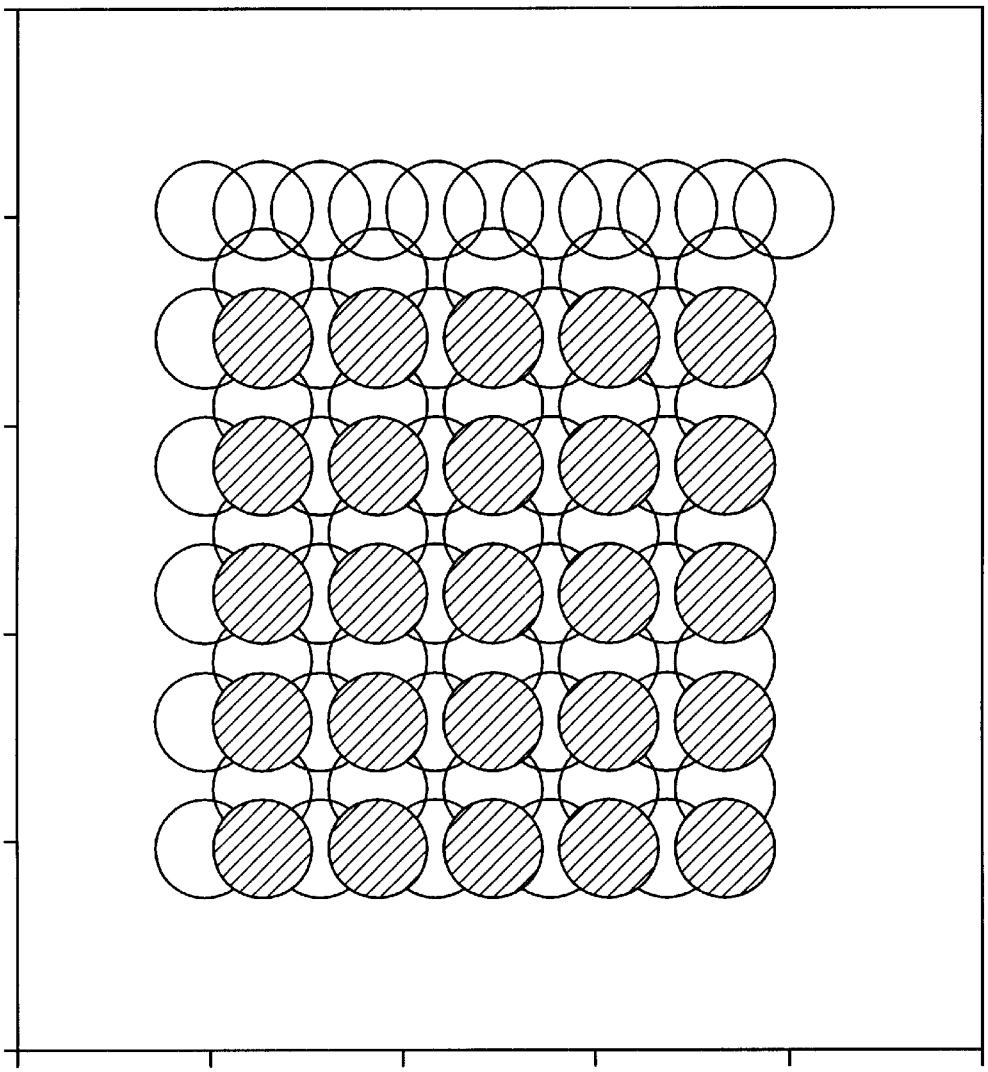

With an optimal choice of the parameters as indicated above, it is possible to create a continuous grid of beams on odd rows by row scanning (FIG. 6), a semi-continuous grid of beams on even rows (FIG. 7) by row scanning and to fill in the holes in odd positions (FIG. 8) by column scanning thereby to complete the coverage (FIG. 9). Row #0 and column #0 are covered through the basic signal processing.

For implementing the invention, the improved system requires at a maximum:

M+1 shift registers with length L,

L multipliers,

L(M+1) adders.

Figure 10:
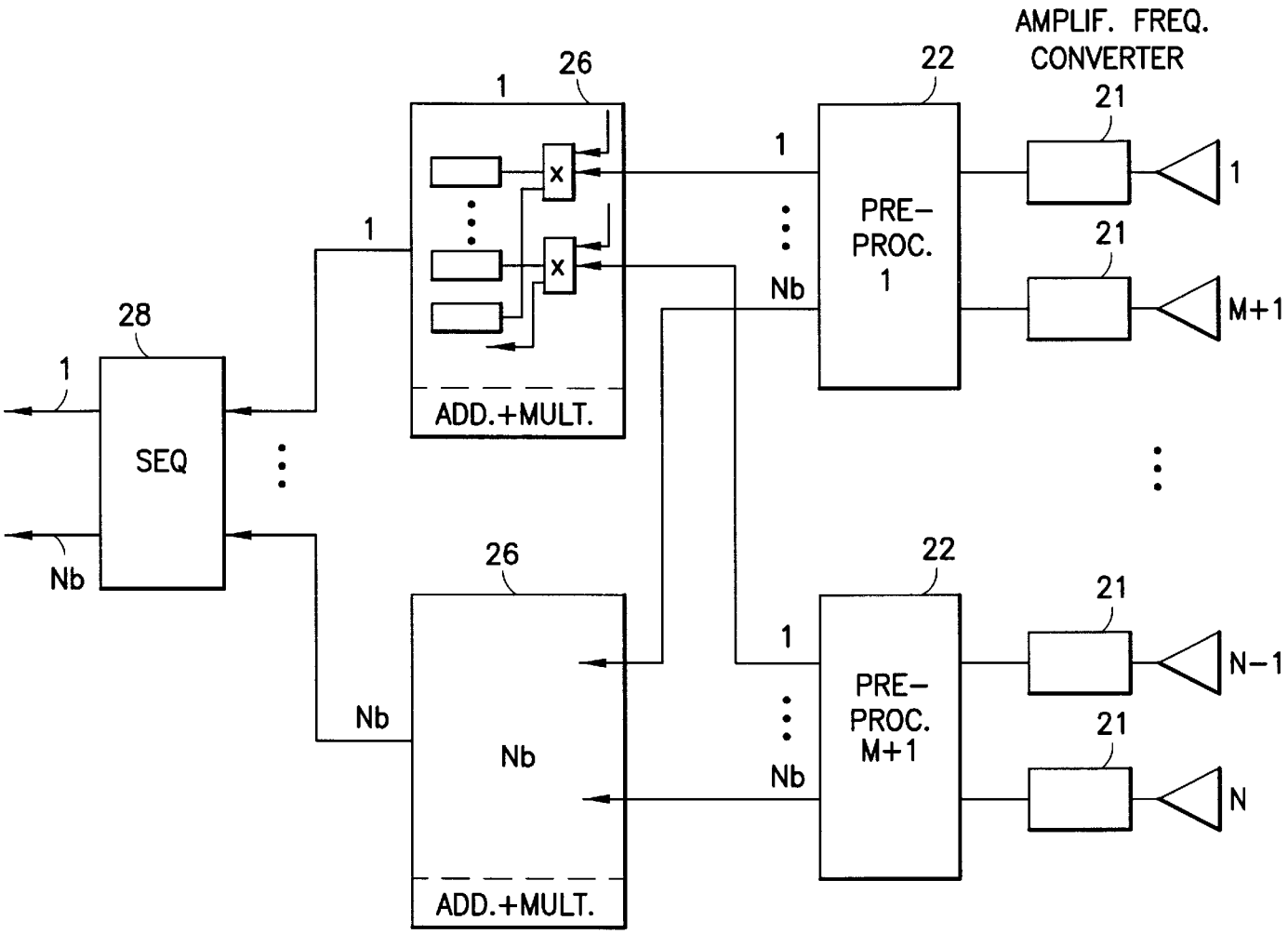
FIG. 10 is a block diagram representing a first exemplary embodiment of a digital beam forming system implementing the method of the invention.
Figure 11:
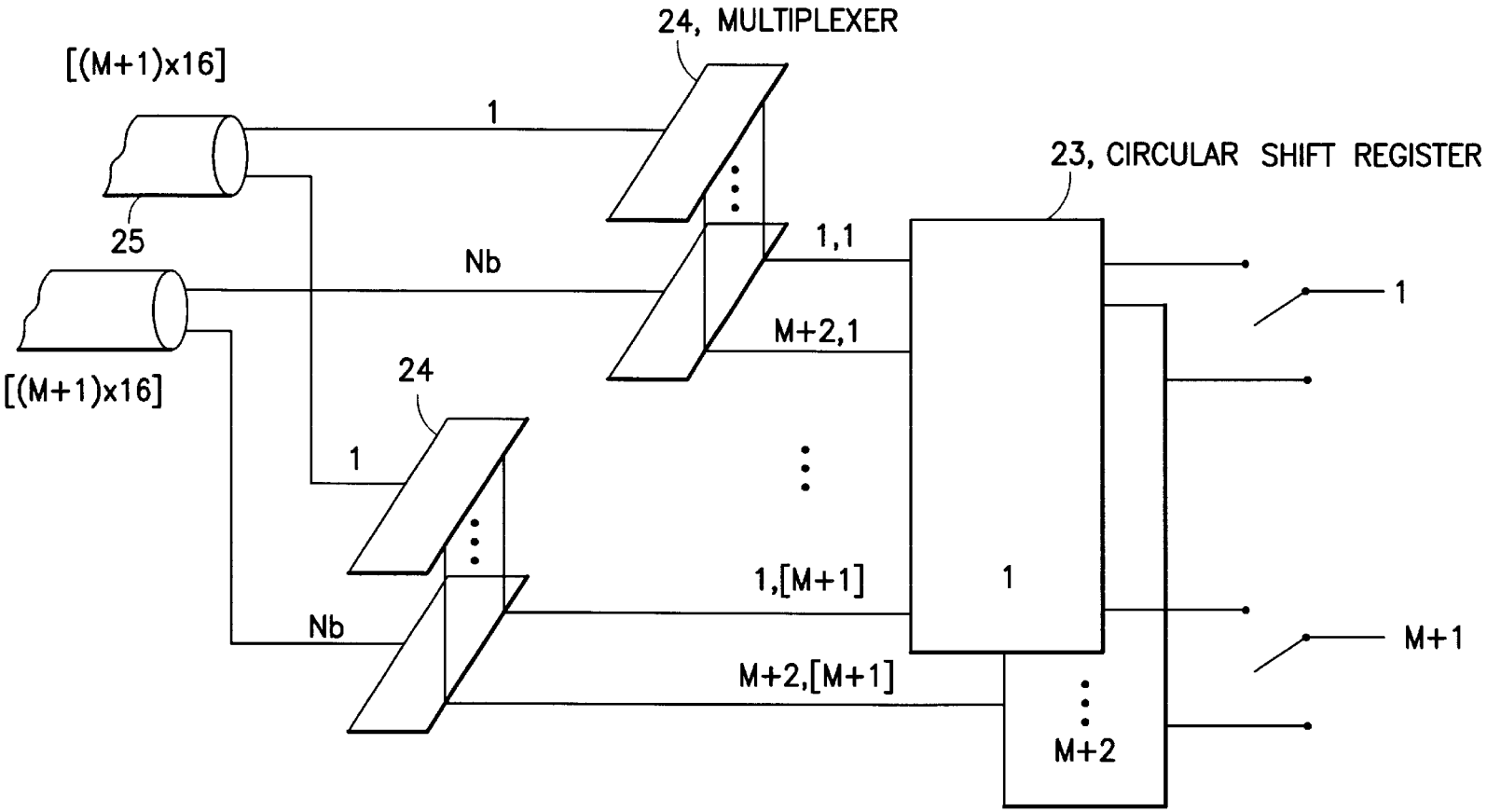
FIG. 11 shows a block diagram representing a portion of the system shown in FIG. 10.
Figure 12:
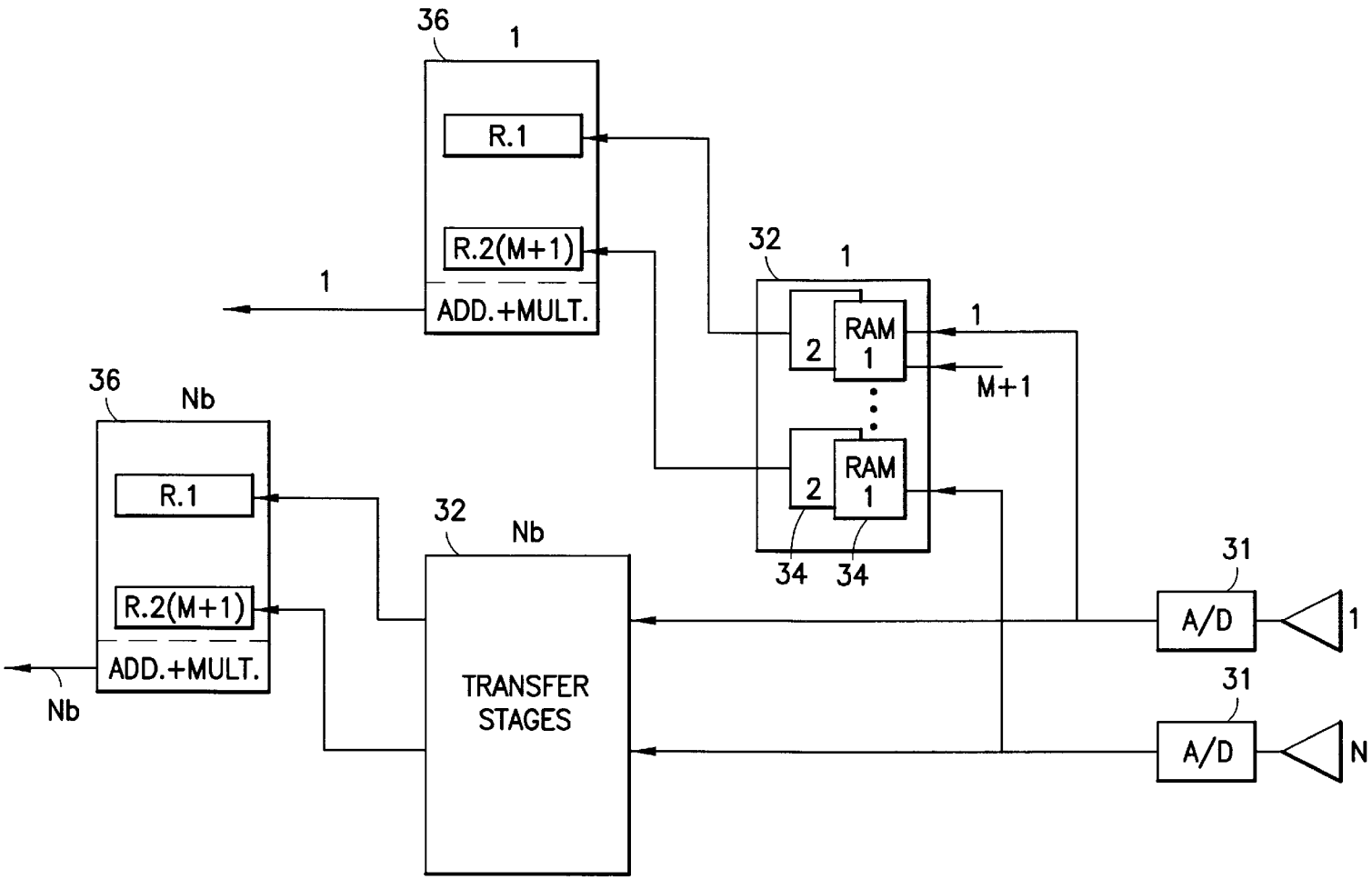
FIG. 12 shows a block diagram representing a second exemplary embodiment of a digital beam forming system implementing the method of the invention.

FIGS. 10 to 12 illustrate exemplary embodiments that permit the digital beam forming method of the invention to be implemented at the receive side of a link. The embodiment represented in FIGS. 10 and 11 is suitable for very high speed processing. An analog-to-digital converter device 21 is used for each array element of the receive antenna, A distinct pre-processor 22 accepts the digital samples from each array element in a row or column and same is adapted to shift the samples by a predetermined number of positions.

Each pre-processor 22 includes a circular shift register 23 followed by a set of multiplexers 24 (FIG. 11) which generate signals and pass them through a number Nb of buses 25 equal to the number of distinct beams to be steered.

The output signals from the pre-processors 22 are passed over to beam forming processors 26, each of which being adapted to form a distinct beam. Each beam forming processor 26 is adapted to perform the addition operations on the received digital signals and to multiply the signals representing each sum thus obtained by a proper phase coefficient. The beam forming processors 26 deliver in-phase signals which are then passed to beam sequencers 28 which restore the correct time sequence for each beam.

FIG. 12 shows a block diagram of an embodiment suitable for moderate speed processing. In this example, a set of RAM's 34 form transfer stages 32 that perform the same function as the circular shift registers of FIG. 11. A transfer stage 32 is provided per row or column of array elements. The RAM's accept the digital samples from the analog-to-digital converters and deliver output signals to the beam forming processors 36 which, in turn, pass their output signals to a beam sequencer (not represented) having the function of restoring the time sequence for each beam.

What is claimed is:

1. A digital beam forming method for forming a plurality of distinct beams at an array antenna including an array of radiating elements arranged along rows and columns having a predetermined spacing, said method comprising the following steps:

(a) converting the wave signals associated with the radiating elements into digital samples;

(b) shifting the samples associated with each of said radiating elements along a plurality of parallel lines parallel to at least one predetermined direction, by a distinct predetermined number of positions along each of said lines;

(c) forming the sum of the samples associated with the corresponding radiating elements of each of said parallel lines;

(d) multiplying each of the sums thus obtained by a respective phase coefficient such that the resulting signals associated with a distinct beam all have the same phase.

2. The method as claimed in claim 1, wherein:

said plurality of parallel lines are parallel to a diagonal of the array of radiating elements, and the sums of samples are formed with the samples associated with the corresponding radiating elements in each of the lines parallel to said diagonal.

3. The method as claimed in claim 1, wherein:

said plurality of parallel lines are parallel to a plurality of diagonals of the array of radiating elements, and the sum of samples are formed with the samples associated with the corresponding radiating elements in each of the lines parallel to each of said diagonals.

4. The method as claimed in claim 2, wherein the radiating elements are scanned separately along odd alternate diagonals and along even alternate diagonals.

5. The method as claimed in claim 1, wherein at least one of the phase coefficients and the shifting step is chosen such that the side lobes of the beam are located within the field of view of the array antenna such that same are taken into account as useful beams in the digital beam forming process.

6. The method as claimed in claim 3, wherein the radiating elements are scanned separately along odd alternate diagonals and along even alternate diagonals.

7. A system for controlling a phased array antenna including an array of radiating elements arranged along rows and columns spaced apart by a predetermined distance, said system comprising:

means for converting the electromagnetic waveform signals into digital samples, a digital beam forming device for forming a plurality of distinct beams, said digital beam forming device comprising:

a group of first processors for shifting the digital samples, each of said first processors being adapted to shift the digital samples by a predetermined number of positions along a distinct predetermined direction, the digital samples corresponding to each of said radiating elements in a row or column parallel to said distinct predetermined direction, a group of second processors for performing summing and multiplying operations on the shifted samples, each of said second processors having a plurality of input ports and an output port, each input port being connected to an output port of a distinct one among said first processors, and the output port delivering signals that are in phase for a distinct beam, each signal representing the sum of the digital samples associated with the corresponding radiating elements in said row or column, multiplied by a respective phase coefficient, and a beam sequencer adapted to control the time sequence of the in-phase signals for each beam.

8. The system as claimed in claim 7, wherein each of said first processors comprises a circular shift register followed by a group of multiplexers.

9. A system for controlling a phased array antenna including an array of radiating elements arranged along rows and columns spaced apart by a predetermined distance, said system comprising:

means for converting the electromagnetic waveform signals into digital samples, a digital beam forming device for forming a plurality of distinct beams, said digital beam forming device comprising:

a group of RAM memory means comprising a plurality of transfer stages for shifting the digital samples associated with the array elements, each stage being adapted to shift the digital samples associated to the array elements in a distinct row or column, and a group of processors for performing summing and multiplication operations on the shifted samples, each of said processors having a plurality of input ports and an output port, each input port being connected to an output port of a distinct transfer stage among said plurality of transfer stages, and the output port delivering signals that are in-phase for a distinct beam, each signal representing the sum of the digital samples associated to the corresponding radiating elements in said row or column, multiplied by a respective phase coefficient, and a beam sequencer adapted to control the time sequence of the in-phase signals for each beam.

* * * * *